United States Patent [19]

Kunito

[11] Patent Number: 4,585,678

[45] Date of Patent: Apr. 29, 1986

[54] STEEL SHEET PILE, SHEET PILE ASSEMBLY THEREOF AND THE METHOD OF CONSTRUCTING THE ASSEMBLY

[75] Inventor: Mitsuhiro Kunito, Osaka, Japan

[73] Assignee: Kabushiki Kaisha ASK Kenkyusho, Osaka, Japan

[21] Appl. No.: 629,664

[22] Filed: Jul. 11, 1984

[51] Int. Cl.[4] ..... E02D 5/02

[52] U.S. Cl. ..... 428/33; 52/588; 405/267; 405/276; 428/131

[58] Field of Search ..... 52/588, 800, 806; 405/267, 274, 276, 277, 278; 428/116, 117, 118, 33, 131

[56] References Cited

U.S. PATENT DOCUMENTS

| | | | |
|---|---|---|---|
| 2,043,891 | 6/1936 | Grave | 405/277 |
| 2,164,681 | 7/1939 | Fould | 428/116 X |
| 3,889,482 | 6/1975 | Frederick | 405/274 |
| 4,090,363 | 5/1978 | List et al. | 405/109 |
| 4,099,387 | 7/1978 | Frederick et al. | 405/274 |
| 4,146,348 | 3/1979 | Kawasaki | 405/236 X |
| 4,259,820 | 4/1981 | Kita et al. | 52/381 X |

FOREIGN PATENT DOCUMENTS

| | | | |
|---|---|---|---|
| 2751972 | 6/1978 | Fed. Rep. of Germany | 405/267 |
| 56-34818 | 4/1981 | Japan | 405/278 |
| 2071188 | 9/1981 | United Kingdom | 405/277 |

*Primary Examiner*—Henry F. Epstein
*Attorney, Agent, or Firm*—Armstrong, Nikaido, Marmelstein & Kubovcik

[57] ABSTRACT

A steel sheet pile for forming the wall of an excavation and the sheet pile assembly are disclosed herein. The steel sheet piles are in use to be arranged in side edge to side edge relationship with each other for supporting the wall of the excavation. Each sheet pile has a generally H-shaped cross section comprising a web with a wide flange on one side thereof and a narrow flange on the opposite side. Formed at the side edges of the wide flange are joint elements which interconnect the adjacent pairs of sheet piles. With this configuration of the sheet pile having the wide and narrow flanges, the sheet piles can be successfully placed along a curved wall or can form a corner portion thereof without the interference between the narrow flanges of the adjacent sheet piles. Accordingly, the sheet piles can be arranged to form not only a straight wall but also curved and corner walls of the excavation, under retention of high rigidity arising from the employment of the generally H-shaped configuration. Also disclosed is a method of constructing the sheet pile assembly with the above sheet piles in which the sheet piles are successively driven into an unsolidified grout curtain to form therewith a consolidated cutoff wall under reduced noise circumstance.

6 Claims, 17 Drawing Figures

STEEL SHEET PILE, SHEET PILE ASSEMBLY THEREOF AND THE METHOD OF CONSTRUCTING THE ASSEMBLY

BACKGROUND OF THE INVENTION

1. Field of the Invention

The present invention is directed to a steel sheet pile for forming the wall of an excavation, the sheet piling assembly formed of a plurality of the steel sheet piles and the method of construction the assembly.

2. Description of the Prior Art

As shown in FIGS. 1 and 2, there have been widely utilized for the construction of such sheetpiling wall channel steel piles 1 with joint elements 2 at their side edges or H steel piles 3 with joint elements 4 at the side edges of each of opposed flanges 5 of equal width. These piles 1 and 3 are in use to be driven into the ground in side edge to side edge relationship with the joints elements interconnecting the adjacent piles. The H steel piles 3 are found to be advantageous over the channel piles 1 from an economical standpoint since they have inherent rigidity higher than the channel piles with respect to unit weight and can be designed in less weight or thickness for the same rigidity required in constructing the sheetpiling wall. However, such H steel piles 3 are designed to be arranged in a straight line along the wall of an excavation such as a trench and a well and therefore find themselves impossible in some situations to be placed along a curved portion and a corner portion of the wall, because the remaining flanges 5 that do not act as the joint will certainly jam with each other when the piles 3 are required to be placed with little intervening space therebetween, as shown in FIG. 3, to prohibit an angled positioning of the H steel pile in relation to the adjacent piles. That is, the prior H piles 3 can be angularly disposed with each other only with considerable spaces therebetween which could weaken the sheet piling wall assembly to an unusable extent. In addition, the use of the H steel pile 3 will sometimes incur a problem that the web 6 of each H steel pile 3 traverses the ground so as to divide the ground into separate portions, resulting in less binding forces between the individual portions of the ground on both sides of each web 6 and between the pile 3 and the ground.

SUMMARY OF THE INVENTION

The above drawbacks have been eliminated by the present invention which provides a steel sheet pile of unique and useful configuration for forming the wall of an excavation. The sheet piles are driven into the ground in side edge to side edge relationship to form the wall in the ground. Each of said sheet piles has a generally H-shaped cross section comprising a web with a wide flange on one side thereof and a narrow flange on the opposite side. Formed at the side edges of the wide flange are joint elements which interconnect the adjacent pairs of sheet piles and which allow a limited angular disposition of an individual sheet pile relative to the adjacent sheet pile. With this configuration of the sheet pile having the wide and narrow flanges in addition to the joint construction of allowing the angular disposition of the sheet pile, the sheet piles can be successfully placed along a curved wall or at a corner portion thereof without requiring considerable intervening spaces between the adjacent sheet piles.

Accordingly, it is a primary object of the present invention to provide steel sheet piles which can be arranged to form not only a straight wall but also curved and corner walls of the excavation, while retaining high rigidity resulting from the employment of the generally H-shaped configuration.

In a preferred embodiment, the sheet pile is formed at its wide flange with an integral rib of generally U-shaped configuration for increasing the mechanical strength of each sheet pile.

In one embodiment, each sheet pile is formed with a series of longitudinally spaced perforations through which the soil of the ground or the like can pass for assuring strong binding of the soil or the like between the portions on both sides of the web and therefore strong binding between the individual piles and the ground.

It is therefore another object of the present invention to provide a sheet pile assembly which assures strong binding between the the individual piles and the ground into which it is driven so as to be cooperative with the ground to form a strong wall of the excavation.

The above sheet piles are particularly advantageous when used in combination with a grout material such as soil-cement or soil-bentonite-cement mixture which is filled within the ground so as to be cooperative with the sheet piles driven thereinto to form a cutoff wall. A method of forming such cutoff wall comprises the steps of forming a loose or unsolidified grout curtain in the ground with that grout material, driving the sheet piles into the loose grout curtain in such a way as to form a continuous sheet pile assembly by connecting the joint elements of the adjacent sheet piles and to permit the grout material to pass through the perforations in the web of each sheet pile, and allowing the loose grout curtain to dry for solidification. With this method, the sheet piles can be sunk in the ground under their own weight or aided by a slight push, enabling the sheet piles to be driven with a greatly reduced noise emission. After construction, the sheet piles serve to be the core of the solidified grout curtain so as to form therewith the consolidated cutoff wall.

It is therefore a further object of the present invention to provide a method of constructing a sheet pile assembly in the ground capable of driving the sheet piles under a greatly reduced noise circumstance to form the consolidated cutoff wall.

These and still other objects of the present invention will be more apparent in the following detailed description of the preferred embodiment when taken in conjunction with the attached drawings.

DETAILED DESCRIPTION OF THE EMBODIMENTS

Figure 1:
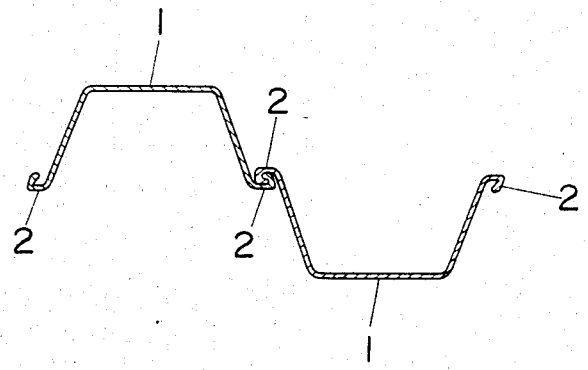
FIG. 1 is a sectional view of a prior sheet piles of channel steel.
Figure 2:
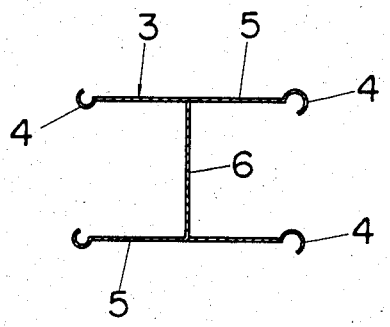
FIG. 2 is a sectional view of another sheet pile of H steel.
Figure 3:
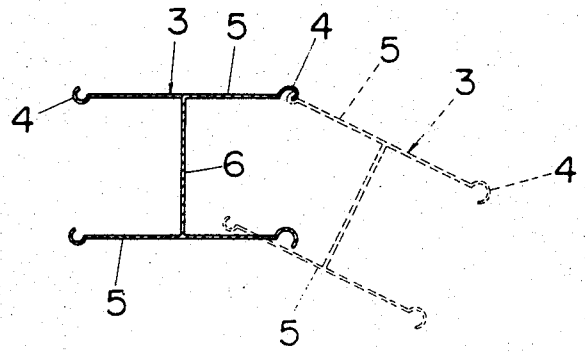
FIG. 3 is a schematic diagram showing the inconvenience encountered in arranging the above H steel pile at an angle with the adjacent one.
Figure 4:
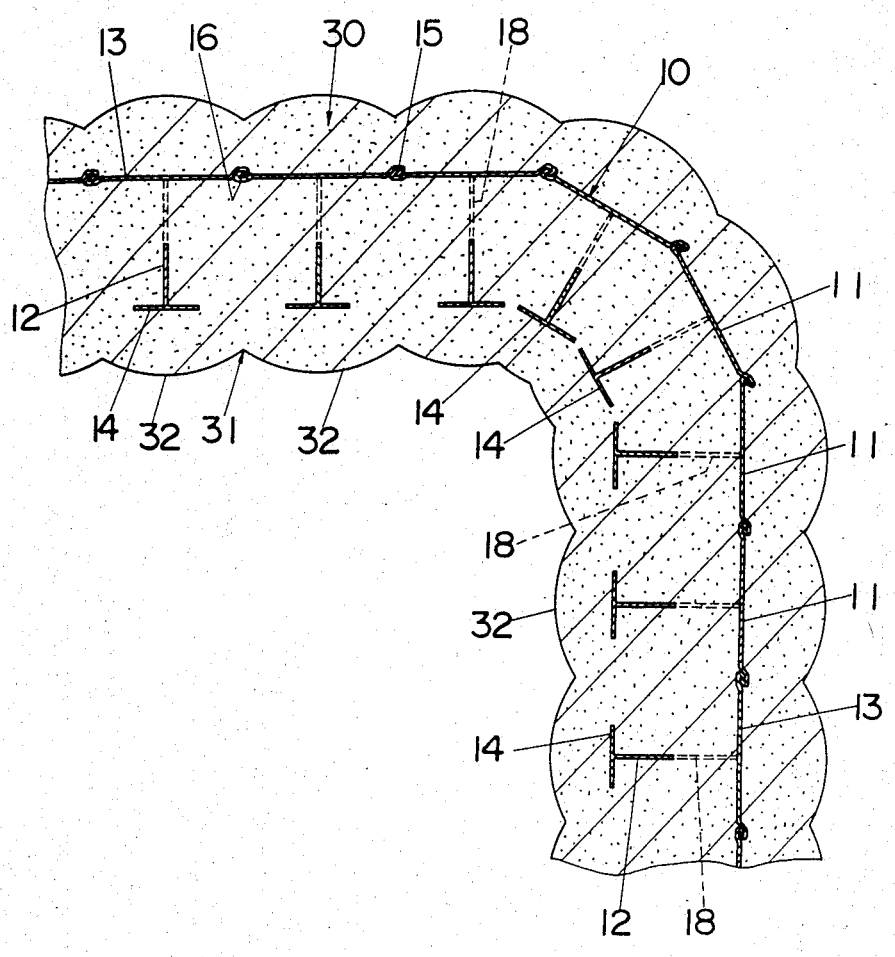
FIG. 4 is a transverse section of a sheet pile assembly formed by the steel sheet piles driven into a grout curtain in the ground in accordance with a preferred embodiment of the present invention.
Figure 5:
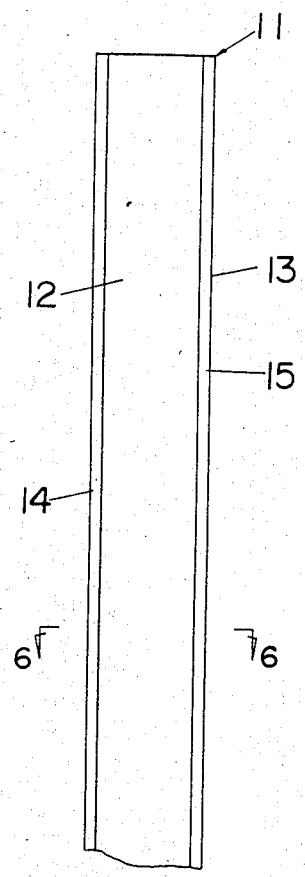
FIG. 5 is a side elevation of a sheet pile employed in the above assembly.
Figure 6:
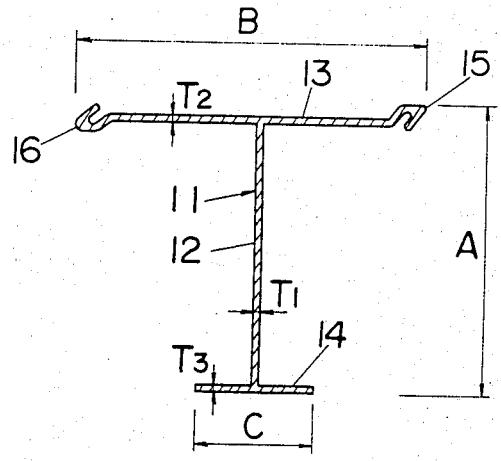
FIG. 6 is a cross section taken along the line 6—6 of FIG. 5.

Referring now to FIGS. 4 through 6, there is shown a sheet pile assembly 10 which is combined with a grout curtain 30 in the ground to form a cofferdam or a cutoff wall of an excavation such as a trench and a well. The sheet pile assembly 10 consists of a series of sheet piles 11 arranged in side edge to side edge relationship with each other to extend along a straight or curved line. Each of the sheet piles 11 is in the form of a generally H-shaped cross section along the entire length thereof comprising a web 12 with a wide flange 13 on one side thereof and a narrow flange 14 on the other side. Formed at the side edges of the wide flange 13 are joint elements 15 and 16 which are U-shaped return hooks, one up-turned and the other down-turned to have their openings facing in opposite directions. Such construction of the joint elements 15 and 16 is conventional and permits the adjacent sheet piles 11 to be interconnected in mutually slidable edge engagement for facilitating the placement of the sheet piles 11 in addition to that it permits a limited angular disposition of the individual sheet pile 11 relative to the adjacent one. The members of the sheet pile 11 employed in the embodiment is dimensioned for example such that width A of web 12, width B of wide flange 13 and width C of narrow flange 14 are 400, 600 and 200 mm and that thickness $T_1$ of web 12, thickness $T_2$ of wide flange 13 and thickness $T_3$ of narrow flange 14 are 4.5, 6 and 18 mm. Although the above dimensions are preferable, the sheet pile of the present invention should not limited to the above dimensional feature except that the narrow flange 14 has a width preferably a half or less of the wide flange 13.

Figure 7:
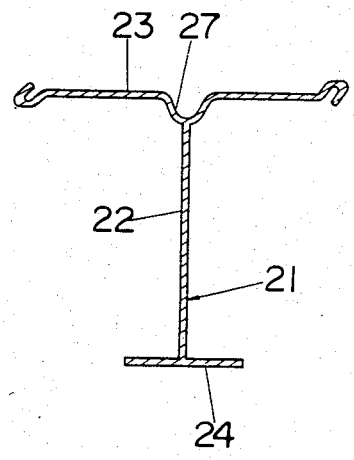
FIG. 7 is a sectional view of modification of the above sheet pile.

FIG. 7 shows a modification of the above sheet pile which is similar to the above except that a sheet pile 21 is formed at its wide flange 23 with an integral rib 27 which is generally U-shaped in cross section and extends longitudinally along the intersection of a web 22 and the wide flange 23 for reinforcement of the sheet piles. Such reinforcing rib 27 may be formed at a portion other than that intersection but within the width of the wide flange 23.

Figure 8:
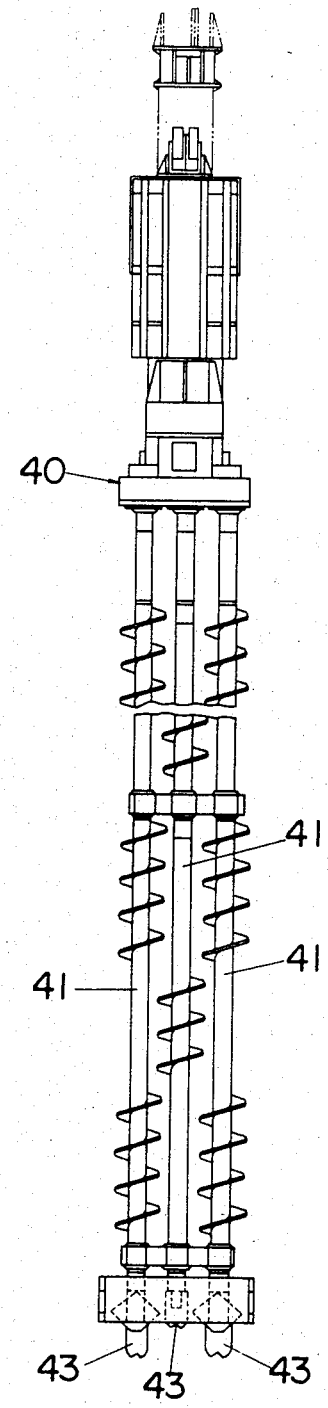
FIG. 8 is a front elevation of a drilling derrick utilized for drilling holes into which the above sheet piles are driven.
Figure 9:
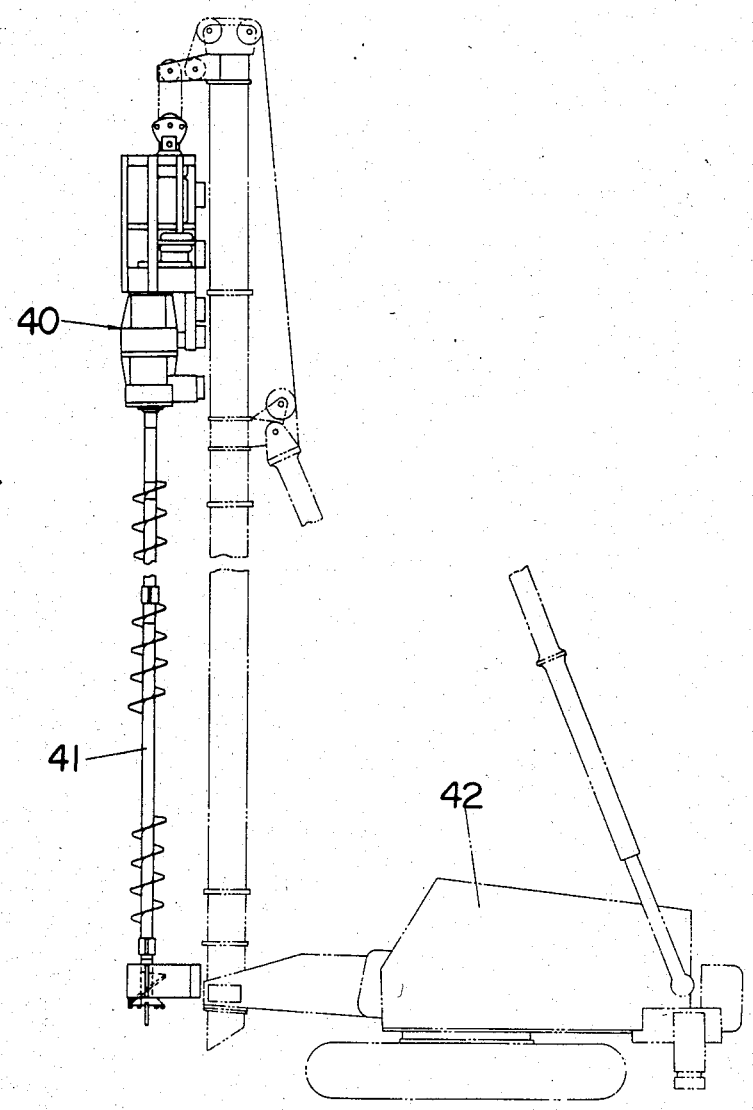
FIG. 9 is a side elevation of the above digging device carried by a crawler crane.
Figure 10A:
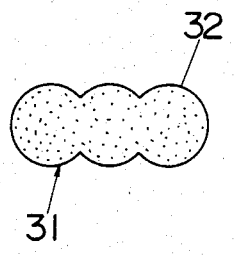
FIGS. 10A and 10B are respectively schematic diagrams showing the plane configurations of the holes in the ground formed by the above digging device and the sheet piles placed in the holes.
Figure 10B:
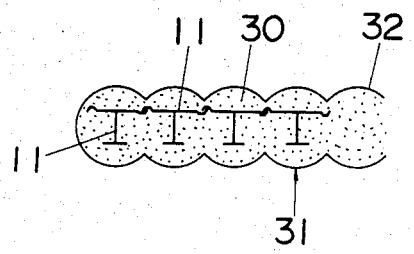
Figure 11:
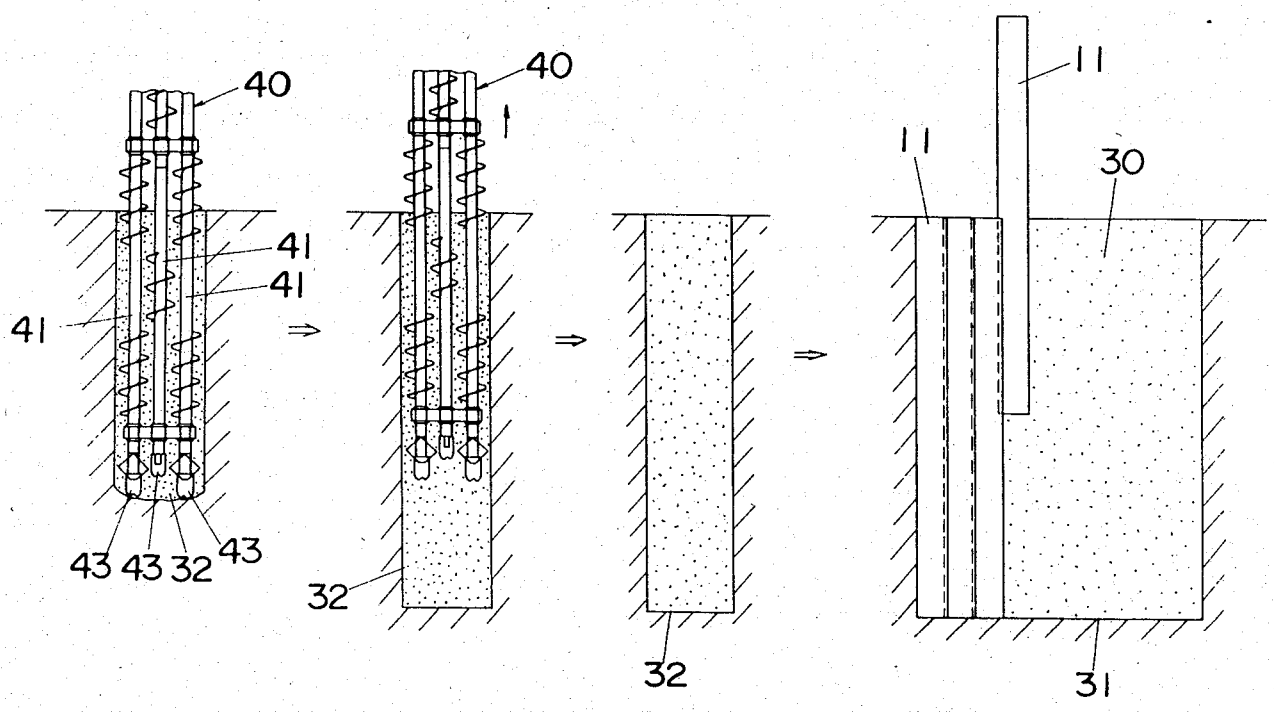
FIG. 11 is a schematic illustration showing the consequence of forming the sheet pile assembly in the ground.

Construction of the above sheet piles 11 are now discussed with reference to FIGS. 8 through 11. The sheet pile assembly 10 of the embodiment is placed in a grout curtain 30, FIGS. 10A, 10B, formed in the ground and cooperative therewith to form a cutoff wall around an excavation. The grout curtain 30 is made of a grout material such as soil-cement or soil-bentonite-cement mixture filled within a ditch 31 defined by a series of consecutive holes 32 dug in the ground. A drilling derrick 40 having three parallel auger shafts 41, as shown in FIGS. 8 and 9, is employed for digging the ditch 31 or the holes 32. The drilling derrick 40 is carried by a crawler crane 42 for easy location thereof. Each of the auger shafts 41 is provided at its tip with a nozzle 43 for injecting cement paste with bentonite added thereto or not. The cement paste injected from the nozzle 42 will be mixed homogeneously with the remaining soil in the holes 32 by the action of the spirals on the auger shafts 41 as the drilling goes on so as to provide a soil-cement or soil-bentonite-cement mixture which defines said grout material for the grout curtain 30. FIG. 11 illustrates a sequence of constructing the above sheet pile assembly 10 from the drilling of the holes 32 to driving of the sheet piles 11 thereinto, from which it is understood that the drilling of holes 32 and filling of the grout material into the holes 32 or ditch 31 are performed within one cycle from diving the auger shafts 41 into the ground to extracting the same from the ground. Accordingly, the holes 32 filled with the grout material is formed within one operational cycle of the drilling derrick 40. Said trench 31 is made by successively performing the above drilling operation in such a manner as to make a required configuration along the perimeter of the excavation to be dug, which simultaneously forms the loose or unsolidified grout curtain 30 of the required configuration in the ground. After forming such loose grout curtain 40 in the ground, said sheet piles 11 are successively inserted in the curtain 30 under their own weights or aided by a slight force applied to the top thereof. In this insertion of the sheet piles 11, the joint elements 15 and 16 can be slid one within the other so as to interconnect the adjacent sheet piles 11 within the loose grout curtain 30, as shown in FIG. 10B, while the grout material can readily permeate in the joint portions between the adjacent joint elements 15 and 16 such that it can securely link the adjacent ones of the sheet piles 11. In this manner, the sheet piles 11 are successively driven into the loose grout curtain 30 to extend therealong. It it noted at this time that the sectional configuration of the sheet pile 11 allows the individual sheet pile 11 to be displaced angularly relative to the adjacent ones without the interference between the narrow flanges 14 of the adjacent sheet piles 11, whereby the sheet pile assembly can conform with not only a straight line but also a curved line or can make a corner portion, as shown in FIG. 4. After solidification of the grout curtain 30, the sheet pile assembly 10 is fixedly installed in the curtain 30 to form therewith the cutoff wall in which the assembly 10 acts as a core structure.

Figure 12:
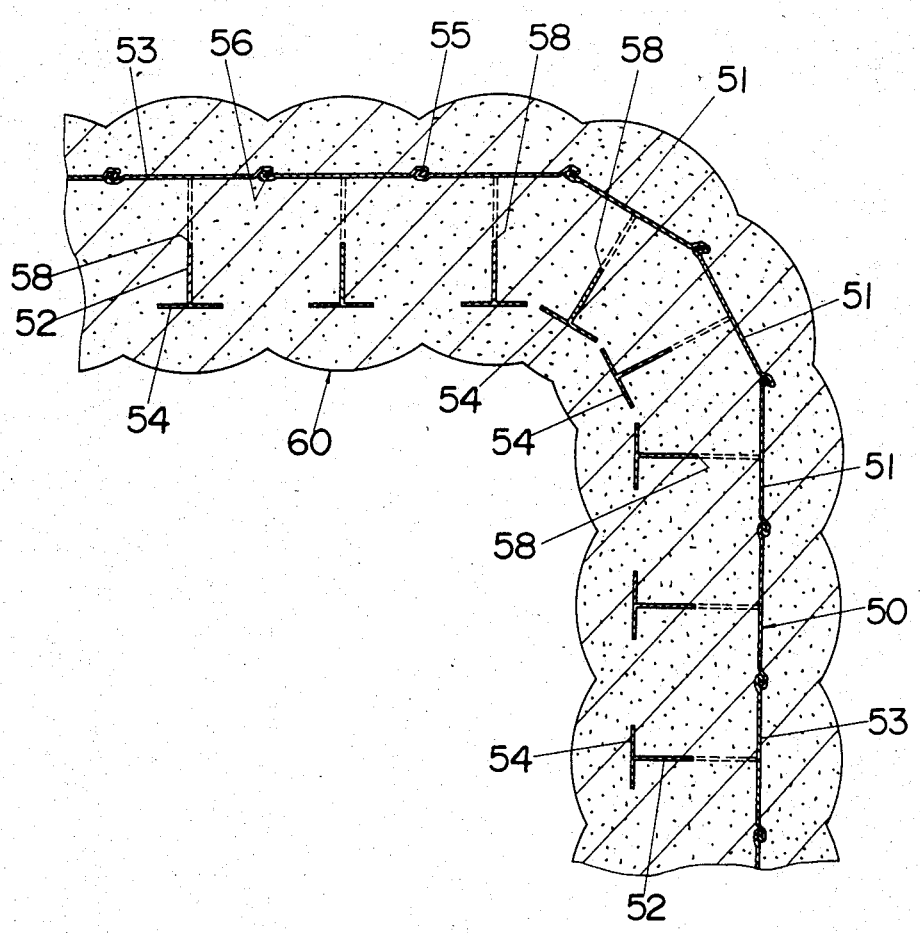
FIG. 12 is a transverse section of a sheet pile assembly formed by the steel sheet piles with perforations driven into a grout curtain in the ground in accordance with another embodiment of the present invention.
Figure 13:
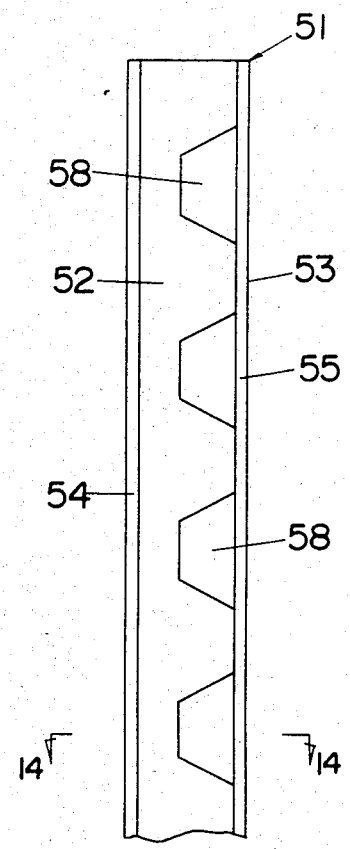
FIG. 13 is a side elevation of a sheet pile employed in the assembly of FIG. 12.
Figure 14:
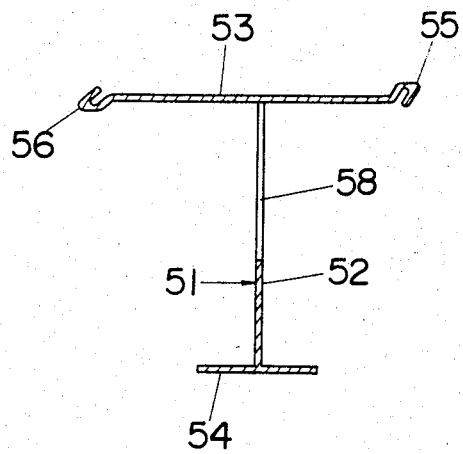
FIG. 14 is a cross section taken along the line 14—14 of FIG. 13.
Figure 15A:
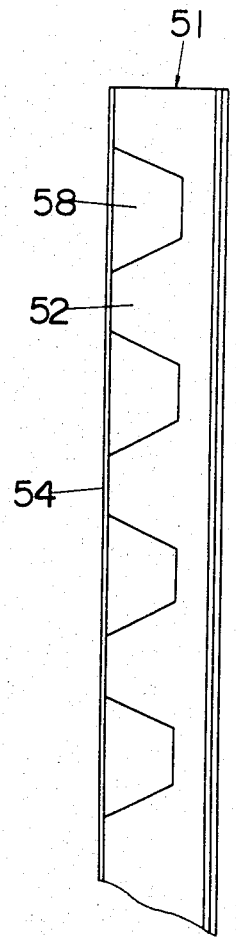
FIGS. 15A and 15B are respectively side elevations of other modifications of the above sheet pile.
Figure 15B:
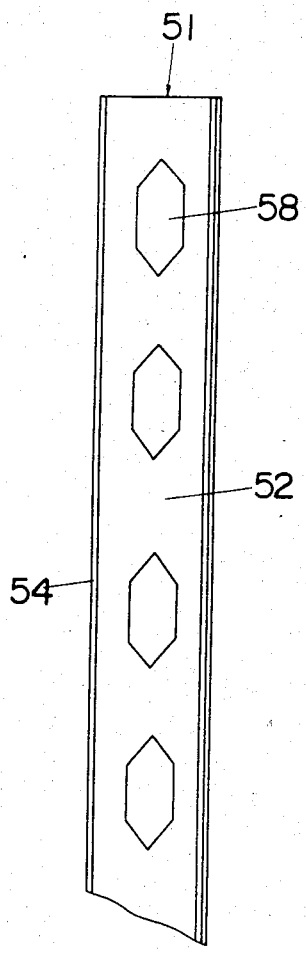

Referring to FIGS. 12 through 14, there is shown a sheet pile assembly 50 formed with the grout curtain 60 in the ground in accordance with another embodiment of the present invention which is similar to the above embodiment except that each of sheet piles 51 is formed in its web 52 with a series of longitudinally spaced perforations 58. Said perforations 58 in the web 52 of each sheet pile 51 allows the like grout material to pass therethrough for assuring strong binding force developed between the portions of the grout curtain 60 on both sides of the web 51 of each sheet pile 51, which in turn assures a strong combining force between the sheet pile assembly 50 and the surrounding grout curtain 60. In this embodiment, each perforation is in the form of a trapezoid with one side thereof along the intersection between the web 52 and the wide flange 53. It is of course that the configuration and location of the perforation 58 should not be limited to the above and may take the forms as illustrated in FIGS. 15A and 15B. As seen in FIG. 14 number 54 represents the narrow flange and numerals 55 and 56 represent joint elements.

Although only one aspect of the construction in which the sheet pile assembly is driven into the grout curtain in the above embodiment, the present invention should not be understood to be limited to the above aspect and the sheet pile assembly can be directly driven into the ground to support the walls of an excavation.

What is claimed is:

1. A steel sheet pile which in use is to be arranged in side edge to side edge relationship with adjacent piles of like construction to form the wall of an excavation, said sheet pile having a generally H-shaped cross section comprising a web with a relatively wide flange on one side thereof, said wide flane having formed integral with and extending along its side edges, joint elements for interconnection with the joint elements integral with and extending along the side edges of the relative wide flanges of adjacently disposed sheet piles and with a relatively narrow reinforcing flange on the other side of said web, the thickness of said narrow reinforcing flange being greater than the thickness of said wide flange.

2. The sheet pile as set forth in claim 1, wherein said wide flange is provided with an integral reinforcing rib of generally U-shaped cross section.

3. The sheet pile as set forth in claim 1, wherein said web is formed with a series of longitudinally spaced perforations.

4. A sheet pile assembly including a series of sheet piles arranged in side edge to side edge relationship with each other for supporting the wall of excavation in which each of said sheet piles has a generally H-shaped cross section comprising a web with a relatively wide flange on one side thereof, said wide flange having formed integral therewith joint elements extending longitudinally along its opposite edges for interconnection with joint elements integral with and extending along the longitudinal edges of the relatively wide flanges of immediatley adjacent sheet piles and a relatively narrow reinforcing flange on the opposite side of said web, said web of said sheet pile having therein a series of longitudinally spaced perforations.

5. A method of constructing a sheet pile assembly in the ground by the use of sheet piles each being shaped in the form of a generally H-shaped cross section having a web with a relatively wide flange on one side thereof, said relatively wide flange of each sheet pile having formed integral with and extending along its side edges joint elements for interconnection with joint elements formed integral with and extending along the side edge of adjacent sheet piles and a relatively narrow but thicker reinforcing flange along said web other side, said method comprising the steps of forming a loose grout curtain in the ground with a grout material such as soil-cement or soil-bentonite-cement mixtures, driving the sheet piles into the loose grout curtain in such a way as to form a continuous sheet pile assembly in the gout curtain by interconnecting the joint elements of the relative wide flanges of adjacent sheet piles and permitting the grout material to permeate in the joint portions between the adjacent joint elements, and allowing the grout curtain to dry and solidify.

6. A method of constructing a sheet pile assembly in the ground by the use of sheet piles each being shaped in the form of a generally H-shaped cross section having a web with a relatively wide flange on one side thereof and a relatively narrow, but thicker reinforcing flange on the opposite side, said relatively wide flange of each sheet pile having formed integral with and extending along its side edges joint elements for interconnection with joint elements formed integral with and extending along the relatively wide flanges of adjacent sheet piles, the web of each sheet pile having therein a series of longitudinally spaced perforations, said method comprising the steps or forming a loose grout curtain in the ground with a grout material such as soil-cement or soil-bentonite-cement mixtures, driving the sheet piles into the loose grout curtain to form a continuous sheet pile assembly in the grout curtain of interconnected sheet piles joined to the joint elements of the adjacent sheet piles, permitting the grout material to permeate in the joint portions between the adjacent joint elements as well as to pass through the perforations in the web of each sheet pile, and allowing the loose grout curtain to dry and solidify.

* * * * *